US008459075B2

(12) United States Patent
Felkl

(10) Patent No.: US 8,459,075 B2
(45) Date of Patent: Jun. 11, 2013

(54) REGULATION METHOD FOR A COLD-ROLLING MILL TRAIN WITH COMPLETE MASS FLOW REGULATION

(75) Inventor: Hans-Joachim Felkl, Forchheim (DE)

(73) Assignee: Siemens Aktiengesellschaft, Munich (DE)

( * ) Notice: Subject to any disclaimer, the term of this patent is extended or adjusted under 35 U.S.C. 154(b) by 327 days.

(21) Appl. No.: 12/865,217

(22) PCT Filed: Jan. 16, 2009

(86) PCT No.: PCT/EP2009/050508

§ 371 (c)(1),
(2), (4) Date: Jul. 29, 2010

(87) PCT Pub. No.: WO2009/095323

PCT Pub. Date: Aug. 6, 2009

(65) Prior Publication Data

US 2010/0326154 A1 Dec. 30, 2010

(30) Foreign Application Priority Data

Jan. 31, 2008 (DE) ..... 10 2008 007 057

(51) Int. Cl.
*B21B 37/46* (2006.01)

(52) U.S. Cl.
USPC ..... 72/11.8; 72/9.2

(58) Field of Classification Search
USPC ..... 72/8.1, 8.3, 9.2, 11.2, 11.8, 16.9, 72/18.1, 18.8, 14.9; 700/151, 155
See application file for complete search history.

(56) References Cited

U.S. PATENT DOCUMENTS

| | | | | |
|---|---|---|---|---|
| 5,495,735 | A * | 3/1996 | Nishimura | 72/8.2 |
| 2004/0221633 | A1 | 11/2004 | Abi-Karam | 72/10.2 |
| 2010/0326154 | A1 | 12/2010 | Felkl | 72/7.6 |

FOREIGN PATENT DOCUMENTS

| | | |
|---|---|---|
| DE | 3925104 | 2/1990 |
| DE | 4243045 | 7/1993 |
| JP | 6210338 | 8/1994 |
| JP | 2004268084 | 9/2004 |
| SU | 1576216 A1 | 7/1990 |
| SU | 1734905 A1 | 5/1992 |
| WO | 2009/095323 A1 | 8/2009 |

OTHER PUBLICATIONS

International Search Report and Written Opinion for Application No. PCT/EP2009/050508 (11 pages), Mar. 31, 2009.

* cited by examiner

*Primary Examiner* — Debra Sullivan
(74) *Attorney, Agent, or Firm* — King & Spalding L.L.P.

(57) ABSTRACT

A cold-rolling train has a plurality of rolling stands and a strip feeding device to which an initial setpoint speed is sent to feed the cold strip to the first stand at an initial actual speed corresponding to the initial setpoint speed. A first setpoint speed is sent to the first stand so that associated rolls rotate. Between the first and next passed-through rolling stand is a thickness detection device detecting a first actual thickness. A base output signal is determined using the first actual and setpoint thicknesses and is used to adjust the first setpoint speed, but not the initial setpoint speed, conforming the first actual to the first setpoint thickness. Between the feeding device and the first rolling stand is an initial thickness detection device detecting an initial actual thickness. The initial setpoint speed is adjusted by a initial feed-forward controller to adjusted a setpoint product mass flow.

19 Claims, 4 Drawing Sheets

REGULATION METHOD FOR A COLD-ROLLING MILL TRAIN WITH COMPLETE MASS FLOW REGULATION

CROSS-REFERENCE TO RELATED APPLICATIONS

This application is a U.S. National Stage Application of International Application No. PCT/EP2009/050508 filed Jan. 16, 2009, which designates the United States of America, and claims priority to DE Application No. 10 2008 007 057.2 filed Jan. 31, 2008. The contents of which are hereby incorporated by reference in their entirety.

TECHNICAL FIELD

The present invention relates to a regulation method for a cold-rolling mill train which has a plurality of rolling stands, through which a cold strip passes in succession, and a strip feeding device arranged upstream of the rolling stand passed through first,

- wherein a initial setpoint speed is supplied to the strip feeding device so that the strip feeding device feeds the cold strip to the rolling stand passed through first at a initial actual speed which corresponds to the initial setpoint speed,
- wherein a first setpoint speed is supplied to the rolling stand passed through first so that rolls of the rolling stand passed through first rotate at a first actual speed which corresponds to the first setpoint speed,
- wherein a first thickness detection device arranged between the rolling stand passed through first and the rolling stand passed through next is used to detect a first actual thickness of the cold strip,
- wherein a basic output signal is determined on the basis of the first actual thickness of the cold strip and a first setpoint thickness of the cold strip.

The present invention also relates to a computer program which has machine code which can be executed directly by a control device for a multi-stand rolling mill train, and the execution of which by the control device has the effect that the control device regulates the cold-rolling mill train in accordance with such a regulation method. The present invention also relates to a data storage medium having such a computer program stored on the data storage medium.

The present invention also relates to a control device for a cold-rolling mill train which has a plurality of rolling stands, through which a cold strip passes in succession, and a strip feeding device arranged upstream of the rolling stand passed through first,

- wherein the control device supplies a initial setpoint speed to the strip feeding device so that the strip feeding device feeds the cold strip to the rolling stand passed through first at a initial actual speed which corresponds to the initial setpoint speed,
- wherein the control device supplies a first setpoint speed to the rolling stand passed through first so that rolls of the rolling stand passed through first rotate at a first actual speed which corresponds to the first setpoint speed,
- wherein the control device receives a first actual thickness of the cold strip from a first thickness detection device arranged between the rolling stand passed through first and the rolling stand passed through next,
- wherein the control device has a thickness regulator which determines a basic output signal on the basis of the first actual thickness of the cold strip and a first setpoint thickness of the cold strip.

Finally, the present invention relates to a cold-rolling mill train,

- wherein the cold-rolling mill train has a plurality of rolling stands through which a cold strip passes in succession,
- wherein the cold-rolling mill train has a strip feeding device arranged upstream of the rolling stand passed through first,
- wherein the cold-rolling mill train has a first thickness detection device, which is arranged between the rolling stand passed through first and the rolling stand passed through next and is used to detect a first actual thickness of the cold strip,
- wherein the cold-rolling mill train has a control device of the type described above, so that the cold-rolling mill train is operated in accordance with a regulation method of the type described above.

BACKGROUND

These subjects are generally known.

DE 39 25 104 A1 discloses an apparatus for the regulation of strip thicknesses in single-stand cold-rolling mills, in which the apparatus has an uncoiler for the strip part running into the rolling stand in the cold-rolling mill and a coiler for the strip part running out of the rolling stand. A device for regulating the speed at which the uncoiler rotates is provided in the sense that the speed of the strip part running in is regulated in relation to the speed of the strip part running out according to the setpoint pass reduction. DE 39 25 104 A1 also states that the corresponding mass flow principle is realized by these measures, and that the use of this principle for regulating multi-stand cold-rolling mill trains is known in principle.

In the case of multi-stand cold-rolling mill trains, the strip thicknesses and the strip tensions are normally set on the basis of the mass flow regulation concept, preferably in the extended variant, according to which a strip feeding device arranged on the inlet side is regarded as a initial rolling stand. The setpoint strip thicknesses are set virtually automatically by virtue of the guideline relating to the strip speeds in the individual sections of the multi-stand rolling mill train (i.e. between two respective directly adjacent rolling stands). However, since the actual speeds of the cold strip in the individual sections can be set only indirectly by way of the circumferential speeds of the rolls in the rolling stands, the lead of the actual speeds of the cold strip in the individual sections in relation to the roll speeds is a factor of uncertainty. The increasingly stringent demands made on the dimensional stability of the rolled products therefore require new methods in order to be able to eliminate these uncertainties in relation to the lead.

In order to solve the problem mentioned above, it is known to damp thickness defects resulting from the unknown leads in the intermediate stands by means of a thickness control loop in the outlet of the cold-rolling mill train. Particularly in the most common mode of operation, in which the last rolling stand in the cold-rolling mill train operates in skin-pass mode (i.e. only with a very small reduction in thickness of, for example, 1% to 2%), the slow monitor regulation at the outlet of the cold-rolling mill train is only able to correct these thickness defects inadequately.

It is known to model the lead on the essential working points of each rolling stand. The circumferential speeds of the rolls are thereby subject to pilot control, in such a way that the actual speeds of the cold strip in the individual sections are as close as possible to the corresponding setpoint values.

Furthermore, if—as is possible in particular in the case of cold-rolling mills having a tension bridle in the inlet—the material flow running in can be fixed at a setpoint mass flow, the uncertainties in relation to lead scarcely have an effect on the target thickness quality when employing the known tension regulation concepts.

SUMMARY

According to various embodiments, possibilities can be provided, by means of which the actual thicknesses running out of at least one of the rolling stands can be set correctly. In this case, the possibility should be combined with correct setting of the inlet-side mass flow.

According to an embodiment, a regulation method for a cold-rolling mill train which has a plurality of rolling stands, through which a cold strip passes in succession, and a strip feeding device arranged upstream of the rolling stand passed through first, wherein an initial setpoint speed is supplied to the strip feeding device so that the strip feeding device feeds the cold strip to the rolling stand passed through first at an initial actual speed which corresponds to the initial setpoint speed, wherein a first setpoint speed is supplied to the rolling stand passed through first so that rolls of the rolling stand passed through first rotate at a first actual speed which corresponds to the first setpoint speed, wherein a first thickness detection device arranged between the rolling stand passed through first and the rolling stand passed through next is used to detect a first actual thickness of the cold strip, wherein a basic output signal is determined on the basis of the first actual thickness of the cold strip and a first setpoint thickness of the cold strip, wherein the first setpoint speed, but not the initial setpoint speed, is adjusted on the basis of the basic output signal, so that the first actual thickness of the cold strip is matched to the first setpoint thickness of the cold strip, wherein an initial thickness detection device arranged between the strip feeding device and the rolling stand passed through first is used to detect an initial actual thickness of the cold strip, wherein an initial feed-forward regulator is used to adjust the initial setpoint speed in such a way that the product of initial setpoint speed and initial actual thickness is set to a setpoint mass flow.

According to a further embodiment, the control device may have a mass flow regulator which receives an initial actual thickness of the cold strip from an initial thickness detection device arranged between the strip feeding device and the rolling stand passed through first, the mass flow regulator furthermore receives the initial actual speed and an actual speed of the cold strip between the rolling stand passed through first and the rolling stand passed through next, and the mass flow regulator uses the variables which it has received to determine an additional output signal, on the basis of which the first setpoint speed, but not the initial setpoint speed, is adjusted, so that the first actual thickness of the cold strip is matched to the first setpoint thickness of the cold strip. According to a further embodiment, the mass flow regulator may also receive the basic output signal. According to a further embodiment, the initial feed-forward regulator may output its output signal in ramped form when the initial feed-forward regulator is connected. According to a further embodiment, a first feed-forward regulator, which receives the first actual thickness of the cold strip from the first thickness detection device, may be used to adjust the first setpoint speed and the initial setpoint speed in the same way. According to a further embodiment, the first feed-forward regulator may output its output signal in ramped form when the first feed-forward regulator is connected.

According to another embodiment, a computer program may have machine code which can be executed directly by a control device for a multi-stand cold-rolling mill train, and the execution of which by the control device may have the effect that the control device regulates the cold-rolling mill train in accordance with a regulation method as described above.

According to yet another embodiment, a data storage medium may have a computer program as described above stored on the data storage medium.

According to yet another embodiment, a control device for a cold-rolling mill train may have a plurality of rolling stands, through which a cold strip passes in succession, and a strip feeding device arranged upstream of the rolling stand passed through first, wherein the control device supplies an initial setpoint speed to the strip feeding device so that the strip feeding device feeds the cold strip to the rolling stand passed through first at an initial actual speed which corresponds to the initial setpoint speed, wherein the control device supplies a first setpoint speed to the rolling stand passed through first so that rolls of the rolling stand passed through first rotate at a first actual speed which corresponds to the first setpoint speed, wherein the control device receives a first actual thickness of the cold strip from a first thickness detection device arranged between the rolling stand passed through first and the rolling stand passed through next, wherein the control device has a thickness regulator which determines a basic output signal on the basis of the first actual thickness of the cold strip and a first setpoint thickness of the cold strip, wherein the control device adjusts the first setpoint speed, but not the initial setpoint speed, on the basis of the basic output signal, so that the first actual thickness of the cold strip is matched to the first setpoint thickness of the cold strip, wherein the control device has a initial feed-forward regulator which receives a initial actual thickness of the cold strip from a initial thickness detection device arranged between the strip feeding device and the rolling stand passed through first, wherein the initial feed-forward regulator adjusts the initial setpoint speed in such a way that the product of initial setpoint speed and initial actual thickness is set to a setpoint mass flow.

According to a further embodiment of the control device, the device can be designed in such a manner that it carries out a regulation method as described above. According to a further embodiment of the control device, the device can be designed as a programmable control device which, during operation, executes a computer program as described above.

According to yet another embodiment, a cold-rolling mill train may have a plurality of rolling stands through which a cold strip passes in succession, wherein the cold-rolling mill train has a strip feeding device arranged upstream of the rolling stand passed through first, wherein the cold-rolling mill train has a first thickness detection device, which is arranged between the rolling stand passed through first and the rolling stand passed through next and is used to detect a first actual thickness of the cold strip, wherein the cold-rolling mill train may have a control device as described above, so that the cold-rolling mill train is operated in accordance with a regulation method as described above.

According to a further embodiment of the col-rolling mill train, the strip feeding device can be designed as a tension bridle or as an uncoiler.

BRIEF DESCRIPTION OF THE DRAWINGS

Further advantages and details emerge from the description of exemplary embodiments, which follows, in conjunction with the drawings, in which, in outline form.

DETAILED DESCRIPTION

Figure 1:
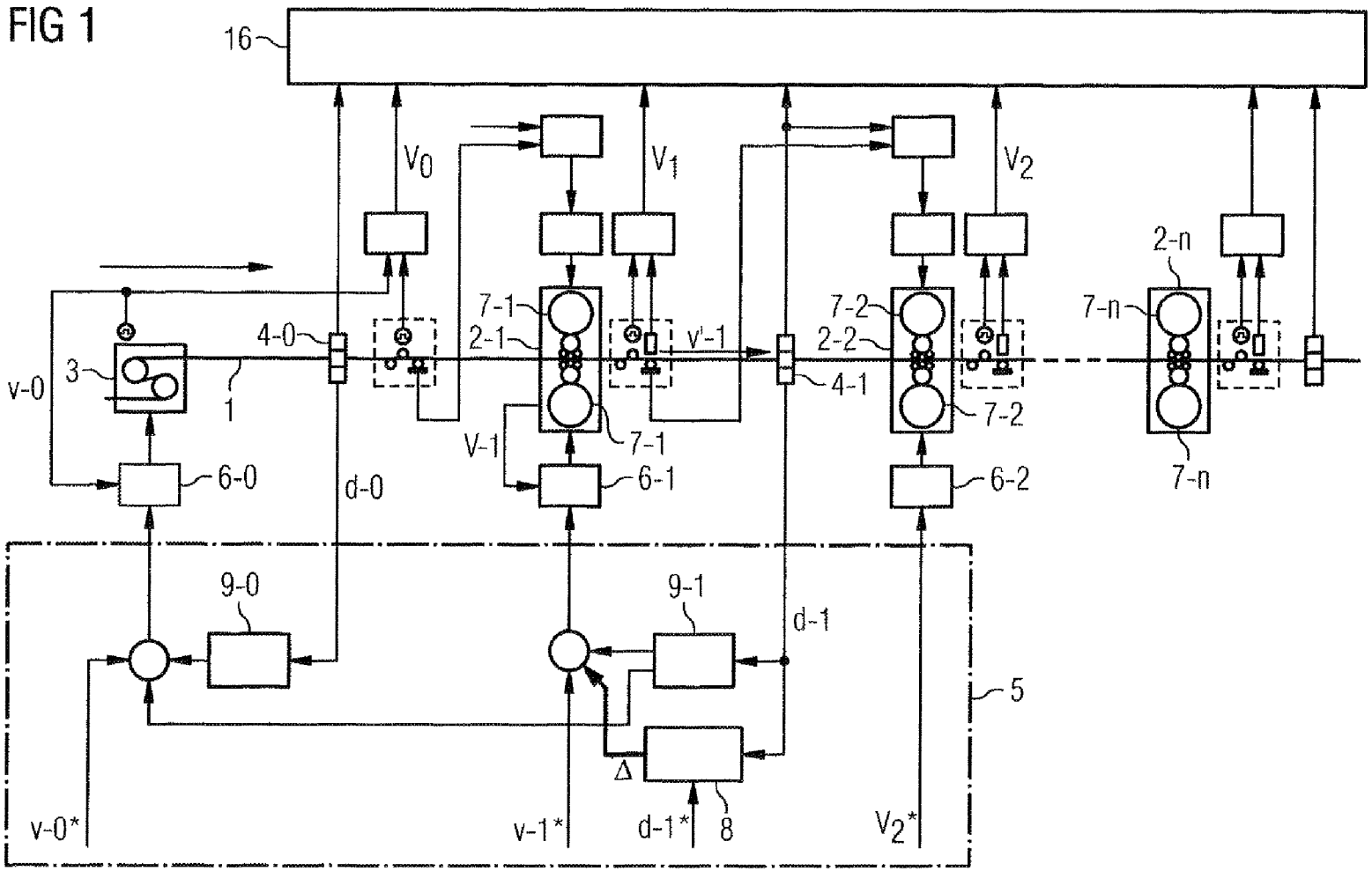
FIG. 1 schematically shows a cold-rolling mill train including a control device for the cold-rolling mill train, FIGS. 2 and 3 schematically show the arrangement of FIG. 1 with a modified control device.

In respect of a regulation method of the type described in the introduction, according to various embodiments,

- the first setpoint speed, but not the initial setpoint speed, is adjusted on the basis of the basic output signal, so that the first actual thickness of the cold strip is matched to the first setpoint thickness of the cold strip,
- a initial thickness detection device arranged between the strip feeding device and the rolling stand passed through first is used to detect a initial actual thickness of the cold strip, and
- a initial feed-forward regulator is used to adjust the initial setpoint speed in such a way that the product of initial setpoint speed and initial actual thickness is set to a setpoint mass flow.

Correspondingly, the computer program is designed in such a way that it carries out these measures. Likewise, the data storage medium has a corresponding computer program.

Furthermore, according to further embodiments, the control device may be embodied by the corresponding measures. The cold-rolling mill train according to various embodiments has a control device of this type, so that the control device, during operation, operates the cold-rolling mill train in accordance with a regulation method of this type.

In one embodiment of the regulation method, it is provided

- that the control device has a mass flow regulator which receives a initial actual thickness of the cold strip from a initial thickness detection device arranged between the strip feeding device and the rolling stand passed through first,
- that the mass flow regulator furthermore receives the initial actual speed and an actual speed of the cold strip between the rolling stand passed through first and the rolling stand passed through next, and
- that the mass flow regulator uses the variables which it has received to determine an additional output signal, on the basis of which the first setpoint speed, but not the initial setpoint speed, is adjusted, so that the first actual thickness of the cold strip is matched to the first setpoint thickness of the cold strip.

This measure makes it possible to achieve improved regulation dynamics.

In one further embodiment of the latter embodiment, the mass flow regulator also receives the basic output signal.

In a further embodiment, the initial feed-forward regulator outputs its output signal in ramped form when the initial feed-forward regulator is connected. This latter measure results in a smoother and more stable connection of the initial feed-forward regulator.

In a further embodiment, it is provided that the control device has a first feed-forward regulator, which receives the first actual thickness from the first thickness detection device. In this case, the first feed-forward regulator adjusts the first setpoint speed and the initial setpoint speed in the same way.

In one further embodiment of the latter embodiment, the first feed-forward regulator outputs its output signal in ramped form when the first feed-forward regulator is connected. This latter measure results in a smoother and more stable connection of the first feed-forward regulator.

The above-described embodiments of the regulation method can also be realized in the case of the computer program and the control device.

The control device can be realized in the form of circuitry. However, the control device is generally designed as a programmable control device which, during operation, executes a computer program of the type described above.

The strip feeding device can be designed as required. By way of example, it can be designed as a tension bridle or as an uncoiler.

As shown in FIG. 1, a cold-rolling mill train for rolling a cold strip 1 has a plurality of rolling stands 2. The cold strip 1 passes through the rolling stands 2 in succession.

If required, in the text which follows a numeral or the letter n is placed in each case after the rolling stands 2 with a hyphen. In this context, the numeral "1" represents the rolling stand 2 passed through first, the numeral "2" represents the rolling stand 2 passed through next, and the letter "n" represents the rolling stand 2 passed through last. Where necessary, the same procedure is also adopted in conjunction with other elements and variables denoted by reference symbols.

The cold-rolling mill train also has a strip feeding device 3. The strip feeding device 3 is arranged upstream of the rolling stand 2-1 passed through first. As shown in FIG. 1, the strip feeding device 3 is designed as a tension bridle. In the text which follows, the strip feeding device 3 is sometimes referred to as the "initial rolling stand". Correspondingly, elements and variables relating to the strip feeding device 3 are provided with the addition "–0", if required.

The cold-rolling mill train also has a first thickness detection device 4-1. The first thickness detection device 4-1 is arranged downstream of the rolling stand 2-1 passed through first, i.e. is arranged between the rolling stand 2-1 passed through first and the rolling stand 2-2 passed through next. The first thickness detection device 4-1 is used to detect a first actual thickness d-1 of the cold strip 1, i.e. the actual thickness d-1 with which the cold strip 1 runs out of the rolling stand 2-1 passed through first.

Finally, the cold-rolling mill train has a control device 5. The control device 5 executes a regulation method explained in detail below. On account of the mode of operation of the control device 5, the cold-rolling mill train is consequently operated in accordance with a regulation method of this type.

According to FIG. 1, the control device 5 supplies a initial setpoint speed v-0* to the strip feeding device 3. The strip feeding device 3 receives the initial setpoint speed v-0* and is attuned in such a way as to feed the cold strip 1 to the rolling stand 2-1 passed through first at a initial actual speed v-0. Here, the initial actual speed v-0 corresponds to the initial setpoint speed v-0*. In order to set the initial actual speed v-0, the strip feeding device 3 can have, for example, a initial speed regulator 6-0, which correspondingly regulates the initial actual speed v-0 of the strip feeding device 3.

As already mentioned, the strip feeding device 3 is regarded logically as the initial rolling stand. However, it does not roll the cold strip 1. A lead or the like therefore does not arise in respect of the strip feeding device 3. The circumferential speed of the strip feeding device 3 therefore corresponds directly to the initial actual speed v-0. It merely has to be ensured that the cold strip 1 does not slip through.

Analogously, the control device 5 supplies a first setpoint speed v-1* to the rolling stand 2-1 passed through first. The rolling stand 2-1 passed through first receives the first setpoint speed v-1* and is attuned in such a way that rolls 7-1 of the rolling stand 2-1 passed through first rotate at a first actual speed v-1 which corresponds to the first setpoint speed v-1*.

The rolling stand 2-1 passed through first rolls the cold strip 1. Therefore, the cold strip 1 emerges from the rolling stand 2-1 passed through first with a lead. An actual speed v'-1 of the cold strip 1 downstream of the rolling stand 2-1 passed through first is therefore greater than the first actual speed v-1. More details relating to this are provided below.

As already mentioned, the first thickness detection device 4-1 is used to detect the first actual thickness d-1. The first thickness detection device 4-1 supplies the first actual thickness d-1 which it has detected to the control device 5. The control device 5 receives the first actual thickness d-1.

The control device 5 internally has a thickness regulator 8. By way of example, the thickness regulator 8 can be designed as a P, PI, PID or another regulator. The first actual thickness d-1 and a first setpoint thickness d-1* are supplied to the thickness regulator 8. The thickness regulator 8 determines a basic output signal Δ on the basis of the first actual thickness d-1 of the cold strip 1 and a first setpoint thickness d-1* of the cold strip 1. The control device 5 adjusts the first setpoint speed v-1* on the basis of the basic output signal Δ, so that the first actual thickness d-1 of the cold strip 1 is matched to the first setpoint thickness d-1* of the cold strip 1. However, the basic output signal Δ is used merely to adjust the first setpoint speed v-1*. By contrast, the initial setpoint speed v-0* is not adjusted, at least not on the basis of the basic output signal Δ.

As a result of the refinement and mode of operation, according to various embodiments of the control device 5, the cold strip 1 runs into the rolling stand 2-2 passed through next with a correct first actual thickness d-1. An appreciable correction of a thickness defect in the last rolling stand 2-*n* is therefore not needed.

According to FIG. 1, the cold-rolling mill train also has a initial thickness detection device 4-0. The initial thickness detection device 4-0 is arranged between the strip feeding device 3 and the rolling stand 2-1 passed through first. It detects a initial actual thickness d-0 of the cold strip 1, i.e. the actual thickness d-0 with which the cold strip 1 runs into the rolling stand 2-1 passed through first.

The initial thickness detection device 4-0 supplies the initial actual thickness d-0 to a initial feed-forward regulator 9-0. In this case, the initial feed-forward regulator 9-0 is a constituent part of the control device 5. The initial feed-forward regulator 9-0 receives the initial actual thickness d-0. It adjusts the initial setpoint speed v-0* in such a way that the product of initial setpoint speed v-0* and initial actual thickness d-0 is set to a setpoint mass flow. Here, the initial feed-forward regulator 9-0 preferably takes into account the distance between the initial thickness detection device 4-0 and the rolling stand 2-1 passed through first, the dynamics of the strip feeding device 3 and the time profile of the initial actual speed v-0. In accordance with displacement monitoring, these measures can have the effect that the corresponding initial setpoint speed v-0* is impinged on the strip feeding device 3 at the correct time (i.e. when the respective corresponding point of the cold strip 1 reaches the rolling stand 2-1 passed through first).

The principle explained above already works very well, but can be improved further by means of the refinements explained below. In this context, the preferred refinements explained below in conjunction with FIGS. 1, 2 and 3 can be realized, as required, as an alternative or in addition.

According to FIG. 1, the control device 5 can also have a first feed-forward regulator 9-1. The first feed-forward regulator 9-1 receives the first actual thickness d-1 from the first thickness detection device 4-1. The first feed-forward regulator 9-1 adjusts the first setpoint speed v-1* and the initial setpoint speed v-0* in the same way.

This refinement does not contradict the regulation by means of the thickness regulator 8. This is because the regulation by means of the first feed-forward regulator 9-1 has different (higher) dynamics to the regulation by means of the thickness regulator 8.

Figure 2:
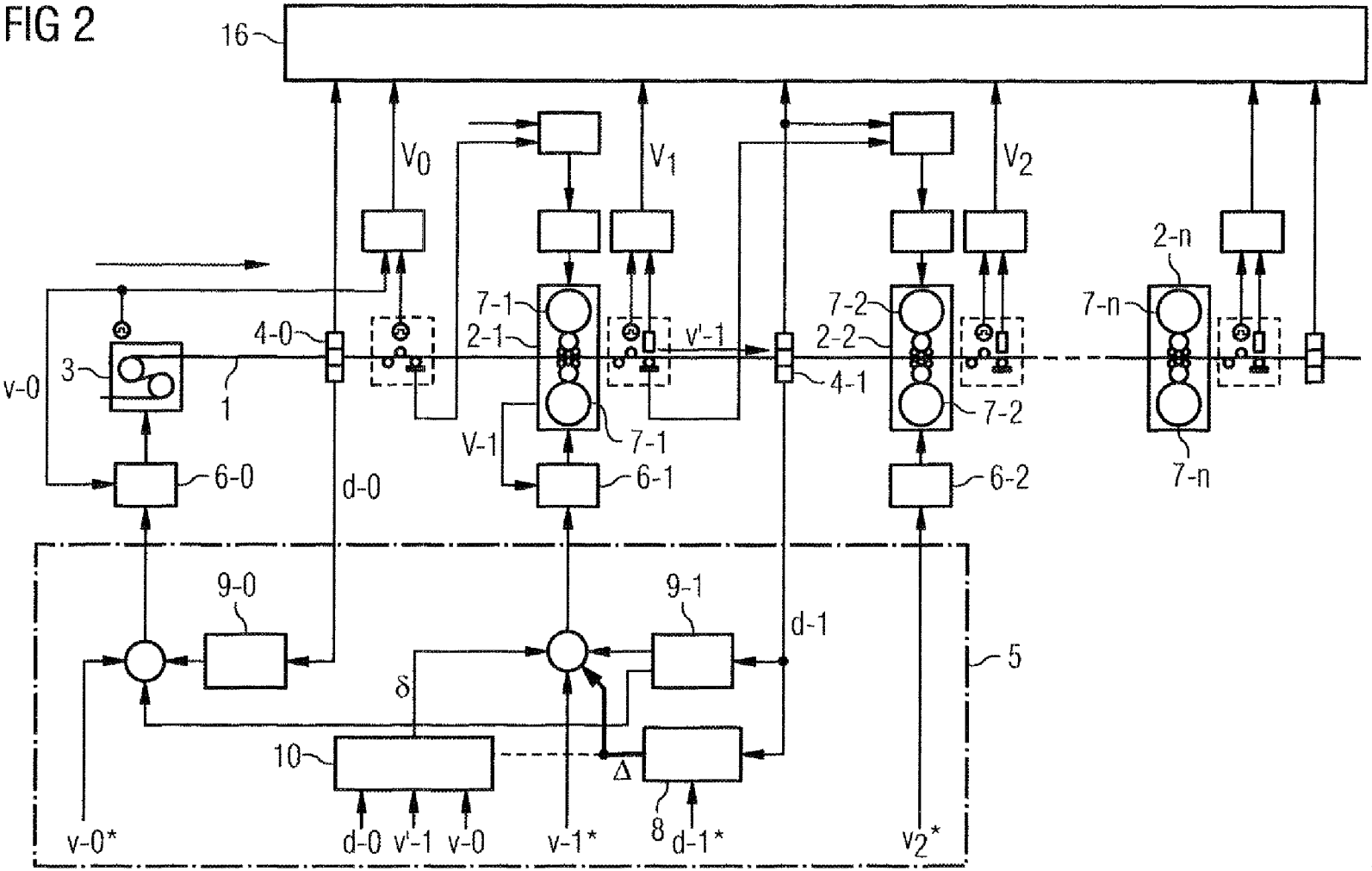

According to FIG. 2, possibly alternatively but generally additionally, the control device 5 can have a mass flow regulator 10 for the above-described refinement of the basic principle according to various embodiments. The mass flow regulator 10 receives the initial actual thickness d-0, the initial actual speed v-0, and the actual speed v'-1 of the cold strip 1 downstream of the rolling stand 2-1 passed through first.

In addition, the mass flow regulator 10 may possibly receive the basic output signal Δ from the thickness regulator 8.

The initial actual thickness d-0 is supplied to the mass flow regulator 10 by the initial thickness detection device 4-0. The initial actual speed v-0 can be detected relatively easily since the strip feeding device 3 does not deform the cold strip 1. It merely has to be ensured that no slip of the cold strip 1 occurs with respect to the strip feeding device 3.

The speed v'-1 of the cold strip 1 between the rolling stand 2-1 passed through first and the rolling stand 2-2 passed through next can be determined on the basis of a modeling of the behavior of the cold strip 1 in the rolling stand 2-1 passed through first, in conjunction with the first actual speed v-1 of the rolls 7-1. However, other procedures are also possible. In particular, it is possible to measure the speed v'-1 of the cold strip 1 downstream of the rolling stand 2-1 passed through first, for example by means of optical methods known per se or using the rotational speed of a measurement roller placed on the cold strip 1.

The mass flow regulator 10 uses the variables supplied to it (i.e. the two speeds v-0 and v'-1, the initial actual thickness d-0 and possibly the basic output signal Δ) to determine an additional output signal δ. Analogously to the basic output signal Δ, the first setpoint speed v-1* is adjusted on the basis of the additional output signal δ, so that the first actual thickness d-1 of the cold strip 1 is matched to the first setpoint thickness d-1* of the cold strip 1. By contrast, analogously to the basic output signal L, the initial setpoint speed v-0* is not adjusted on the basis of the additional output signal δ.

The refinement shown in FIG. 2 is expedient since although the correction by means of the additional output signal δ—in contrast to the correction by means of the basic output signal Δ—is relatively inaccurate, considerably higher dynamics are possible therefor.

Figure 3:
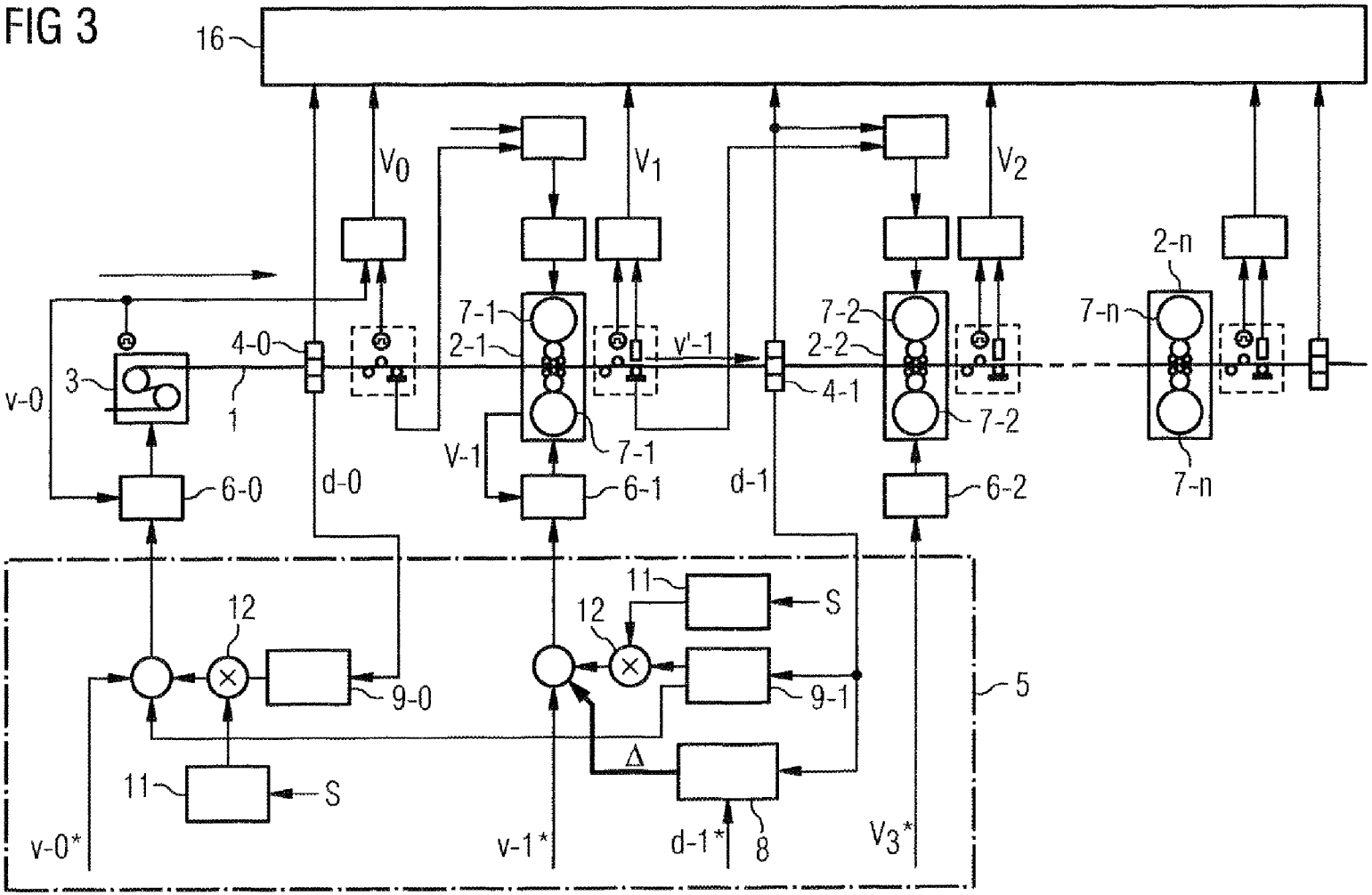

FIG. 3 substantially shows a refinement similar to that in FIG. 1. The difference in relation to the refinement in FIG. 1 is that ramp generators 11 and multipliers 12 are additionally present. When a respective start signal S is supplied to the ramp generators 11, the ramp generators 11 increase their output signals gradually from zero to one. The multipliers 12 receive the output signal of their respective ramp generator 11 and the output signal of the initial or of the first feed-forward regulator 9-0, 9-1 and output the product of their two input signals as their output signal. The multipliers 12, in combination with the ramp generators 11, thus have the effect that the output signal of the initial or of the first feed-forward regulator 9-0, 9-1 is output in ramped form.

The respective start signal S is supplied to the ramp generators 11 at a suitable point in time. Here, the point in time is chosen so as to fall within a time period in which a head of the cold strip 1 has not yet run into the rolling stand 2-1 passed through first, or indeed has already emerged from the rolling stand 2-1 passed through first, but has not yet run into the rolling stand 2-2 passed through next. Therefore, the ramping takes place during the rolling of the cold strip 1.

The control device 5 shown in FIG. 1 to 3 can be realized in the form of circuitry. However, in many cases, corresponding to FIG. 4, the control device 5 is designed as a (software) programmable control device which, during operation, executes a computer program 13. Irrespective of whether the control device 5 is realized in the form of circuitry or is (software) programmable, during operation the control device 5 can, however, alternatively realize a regulation method in accordance with the basic principle of the various embodiments explained above, or a regulation method in accordance with one of the preferred refinements of the regulation method according to various embodiments, which are likewise explained above.

If the control device 5 is software-programmable, the corresponding computer program 13 has machine code 14. The machine code 14 can be executed directly by the control device 5. The execution of the machine code 14 by the control device 5 has the effect that the control device 5 regulates the cold-rolling mill train in accordance with one of the regulation methods explained in more detail above.

The computer program 13 may already be stored in the control device 5 during the production of the control device 5.

Alternatively, it is possible to supply the computer program 13 to the control device 5 via a computer-computer link (for example a LAN or the Internet). In turn, it is alternatively possible to store the computer program 13 on a data storage medium 15 and to supply the computer program 13 to the control device 5 via the data storage medium 15. Purely by way of example, the data storage medium 15 is shown as a CD-ROM in FIG. 4. However, it could alternatively have a different design, for example a USB memory stick or a memory card.

Figure 4:
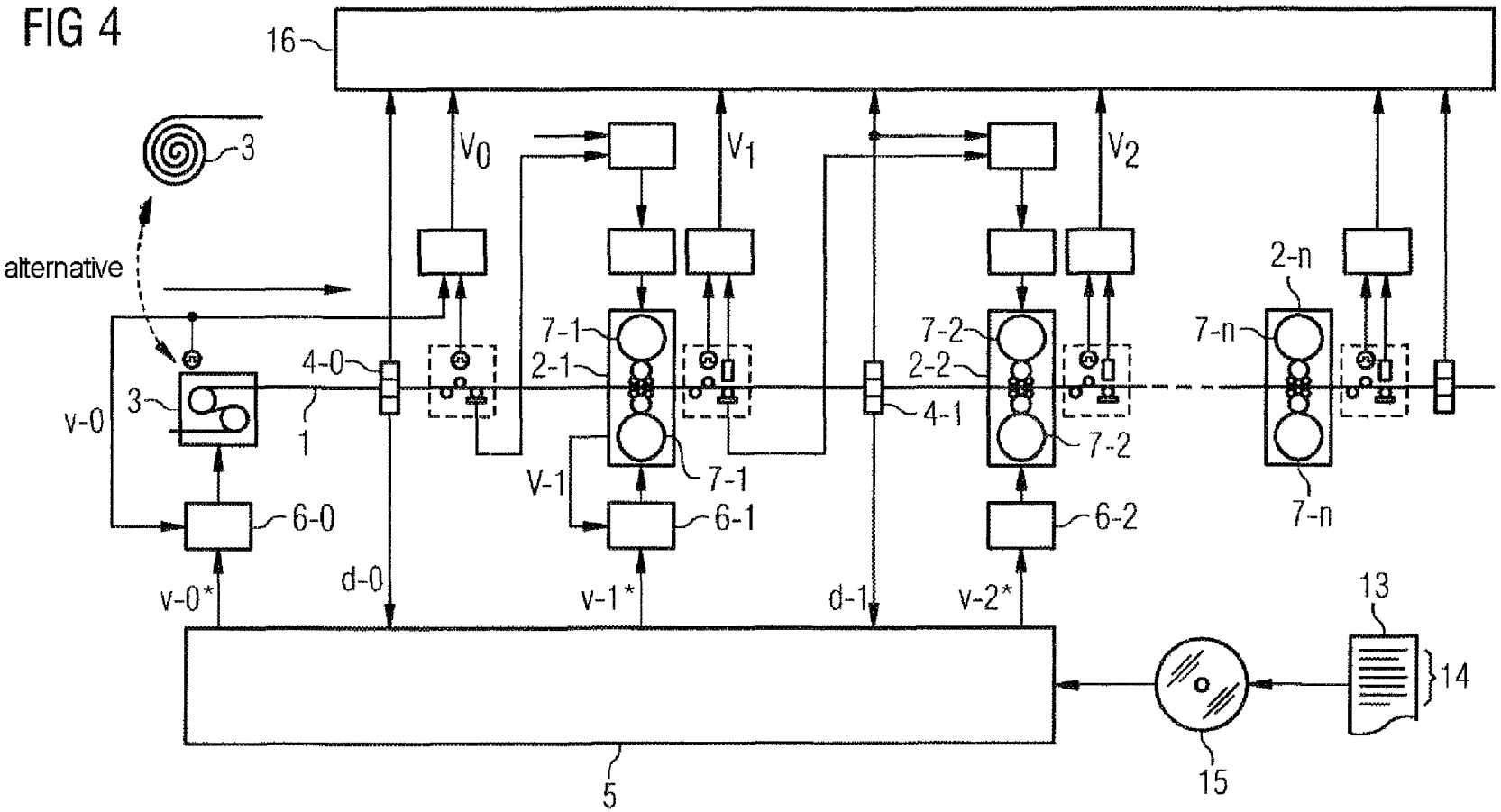
FIG. 4 shows a possible refinement of the control device shown in FIG. 1 to 3.

FIG. 4 also shows two alternative refinements of the strip feeding device 3, specifically firstly as a tension bridle (as in FIG. 1 to 3) and secondly as an uncoiler (only in FIG. 4). The latter refinement of the strip feeding device 3 can clearly also be realized in the case of the cold-rolling mill trains shown in FIG. 1 to 3.

The various embodiments have many advantages. In particular, the first actual thickness d-1 of the cold strip 1 is set correctly. In conjunction with the initial feed-forward regulator 9-0, a further effect is that the mass flow through the cold-rolling mill train is also set correctly. Nevertheless, the design of the control device 5 in terms of regulation has a fascinating simplicity. In particular, only a few inter-coupled regulations are required. Furthermore, during operation of the cold-rolling mill train according to various embodiments, considerably improved dimensional stability of the actual thickness d-n is obtained downstream of the rolling stand **2-*n* passed through last in the cold-rolling mill train, to be precise both under static operating conditions and under dynamic operating conditions (for example acceleration or deceleration of the cold strip 1 or weld seam pass). Furthermore, the additional output signal $\delta$ of the mass flow regulator 10 is a direct indication for the modeling quality of the lead and can thus be used outstandingly for possible adaptation of a process model 16**.

The above description serves exclusively to explain the present invention. The scope of protection of the present invention, by contrast, should be defined exclusively by the appended claims.

What is claimed is:

1. A regulation method for a cold-rolling mill train which has a plurality of rolling stands, through which a cold strip passes in succession, and a strip feeding device arranged upstream of the rolling stand passed through first, the method comprising:

supplying an initial setpoint speed to the strip feeding device so that the strip feeding device feeds the cold strip to the rolling stand passed through first at an initial actual speed which corresponds to the initial setpoint speed, supplying a first setpoint speed to the rolling stand passed through first so that rolls of the rolling stand passed through first rotate at a first actual speed which corresponds to the first setpoint speed, using a first thickness detection device arranged between the rolling stand passed through first and the rolling stand passed through next to detect a first actual thickness of the cold strip, determining a basic output signal on the basis of the first actual thickness of the cold strip and a first setpoint thickness of the cold strip, adjusting the first setpoint speed, but not the initial setpoint speed, on the basis of the basic output signal, so that the first actual thickness of the cold strip is matched to the first setpoint thickness of the cold strip, using a initial thickness detection device arranged between the strip feeding device and the rolling stand passed through first to detect an initial actual thickness of the cold strip, and using an initial feed-forward regulator to adjust the initial setpoint speed in such a way that the product of initial setpoint speed and initial actual thickness is set to a setpoint mass flow.

2. The regulation method according to claim 1, wherein a mass flow regulator receives the initial actual thickness of the cold strip from the initial thickness detection device arranged between the strip feeding device and the rolling stand passed through first, the mass flow regulator furthermore receives the initial actual speed and an actual speed of the cold strip between the rolling stand passed through first and the rolling stand passed through next, and the mass flow regulator determines an additional output signal, on the basis of which the first setpoint speed, but not the initial setpoint speed, is adjusted, so that the first actual thickness of the cold strip is matched to the first setpoint thickness of the cold strip.

3. The regulation method according to claim 2, wherein the mass flow regulator also receives the basic output signal.

4. The regulation method according to claim 1, wherein the initial feed-forward regulator outputs its output signal in ramped form when the initial feed-forward regulator is connected.

5. The regulation method according to claim 1, wherein a first feed-forward regulator, which receives the first actual thickness of the cold strip from the first thickness detection device, is used to adjust the first setpoint speed and the initial setpoint speed in the same way.

6. The regulation method according to claim 5, wherein the first feed-forward regulator outputs its output signal in ramped form when the first feed-forward regulator is connected.

7. A computer program product comprising a tangible data storage medium storing machine code which when executed directly by a control device for a multi-stand cold-rolling mill train has the effect that the control device regulates a cold-rolling mill train such that an initial setpoint speed is supplied to the strip feeding device so that the strip feeding device feeds the cold strip to the rolling stand passed through first at an initial actual speed which corresponds to the initial setpoint speed, a first setpoint speed is supplied to the rolling stand passed through first so that rolls of the rolling stand passed through first rotate at a first actual speed which corresponds to the first setpoint speed, a first thickness detection device arranged between the rolling stand passed through first and the rolling stand passed through next is used to detect a first actual thickness of the cold strip, a basic output signal is determined on the basis of the first actual thickness of the cold strip and a first setpoint thickness of the cold strip, the first setpoint speed, but not the initial setpoint speed, is adjusted on the basis of the basic output signal, so that the first actual thickness of the cold strip is matched to the first setpoint thickness of the cold strip, a initial thickness detection device arranged between the strip feeding device and the rolling stand passed through first is used to detect an initial actual thickness of the cold strip, and an initial feed-forward regulator is used to adjust the initial setpoint speed in such a way that the product of initial setpoint speed and initial actual thickness is set to a setpoint mass flow.

8. The computer program product according to claim 7, wherein the control device has a mass flow regulator which receives the initial actual thickness of the cold strip from the initial thickness detection device arranged between the strip feeding device and the rolling stand passed through first, the mass flow regulator furthermore receives the initial actual speed and an actual speed of the cold strip between the rolling stand passed through first and the rolling stand passed through next, and the mass flow regulator determines an additional output signal, on the basis of which the first setpoint speed, but not the initial setpoint speed, is adjusted, so that the first actual thickness of the cold strip is matched to the first setpoint thickness of the cold strip.

9. A control device for a cold-rolling mill train which has a plurality of rolling stands, through which a cold strip passes in succession, and a strip feeding device arranged upstream of the rolling stand passed through first, wherein the control device supplies an initial setpoint speed to the strip feeding device so that the strip feeding device feeds the cold strip to the rolling stand passed through first at an initial actual speed which corresponds to the initial setpoint speed, wherein the control device supplies a first setpoint speed to the rolling stand passed through first so that rolls of the rolling stand passed through first rotate at a first actual speed which corresponds to the first setpoint speed, wherein the control device receives a first actual thickness of the cold strip from a first thickness detection device arranged between the rolling stand passed through first and the rolling stand passed through next, wherein the control device has a thickness regulator which determines a basic output signal on the basis of the first actual thickness of the cold strip and a first setpoint thickness of the cold strip, wherein the control device adjusts the first setpoint speed, but not the initial setpoint speed, on the basis of the basic output signal, so that the first actual thickness of the cold strip is matched to the first setpoint thickness of the cold strip, wherein the control device has an initial feed-forward regulator which receives a initial actual thickness of the cold strip from an initial thickness detection device arranged between the strip feeding device and the rolling stand passed through first, wherein the initial feed-forward regulator adjusts the initial setpoint speed in such a way that the product of initial setpoint speed and initial actual thickness is set to a setpoint mass flow.

10. The control device according to claim 9, wherein the control device has a mass flow regulator which receives the initial actual thickness of the cold strip from the initial thickness detection device arranged between the strip feeding device and the rolling stand passed through first, the mass flow regulator furthermore receives the initial actual speed and an actual speed of the cold strip between the rolling stand passed through first and the rolling stand passed through next, and the mass flow regulator determines an additional output signal, on the basis of which the first setpoint speed, but not the initial setpoint speed, is adjusted, so that the first actual thickness of the cold strip is matched to the first setpoint thickness of the cold strip.

11. The control device according to claim 10, wherein the mass flow regulator also receives the basic output signal.

12. The control device according to claim 9, wherein the device is designed as a programmable control device which, during operation, executes a computer program.

13. The control device according to claim 9, wherein the initial feed-forward regulator outputs its output signal in ramped form when the initial feed-forward regulator is connected.

14. The control device according to claim 9, wherein a first feed-forward regulator, which receives the first actual thickness of the cold strip from the first thickness detection device, is used to adjust the first setpoint speed and the initial setpoint speed in the same way.

15. The control device according to claim 14, wherein the first feed-forward regulator outputs its output signal in ramped form when the first feed-forward regulator is connected.

16. A cold-rolling mill train, wherein the cold-rolling mill train has a plurality of rolling stands through which a cold strip passes in succession, wherein the cold-rolling mill train has a strip feeding device arranged upstream of the rolling stand passed through first, wherein the cold-rolling mill train has a first thickness detection device, which is arranged between the rolling stand passed through first and the rolling stand passed through next and is used to detect a first actual thickness of the cold strip, wherein the cold-rolling mill train has a control device according to claim 9.

17. The cold-rolling mill train according to claim 16, wherein the strip feeding device is designed as a tension bridle or as an uncoiler.

18. The cold-rolling mill train according to claim 16, wherein the control device has a mass flow regulator which receives the initial actual thickness of the cold strip from the initial thickness detection device arranged between the strip feeding device and the rolling stand passed through first, the mass flow regulator furthermore receives the initial actual speed and an actual speed of the cold strip between the rolling stand passed through first and the rolling stand passed through next, and the mass flow regulator determines an additional output signal, on the basis of which the first setpoint speed, but not the initial setpoint speed, is adjusted, so that the first actual thickness of the cold strip is matched to the first setpoint thickness of the cold strip.

19. The cold-rolling mill train according to claim 16, wherein the device is designed as a programmable control device which, during operation, executes a computer program.

* * * * *